United States Patent [19]

Owen

[11] 4,201,899

[45] May 6, 1980

[54] POWER ACTUATOR FOR A COAXIAL R F POWER SWITCH

[76] Inventor: Kenneth Owen, 6201 Hibbling La., Springfield, Va. 22150

[21] Appl. No.: 913,970

[22] Filed: Jun. 9, 1978

Related U.S. Application Data

[63] Continuation-in-part of Ser. No. 806,485, Jun. 14, 1977, abandoned.

[51] Int. Cl.[2] ..... H01H 3/00

[52] U.S. Cl. ..... 200/153 R; 200/18; 200/153 L; 200/153 LA; 200/153 P; 200/153 LB; 200/153 S; 200/153 V

[58] Field of Search ..... 200/18, 153 R, 153 P, 200/153 V, 153 S, 153 L, 153 LA, 153 LB, 330

[56] References Cited

U.S. PATENT DOCUMENTS

| | | | |
|---|---|---|---|
| 1,491,223 | 4/1924 | Casner | 200/153 V |
| 2,509,928 | 5/1950 | Klein | 200/153 S |
| 3,150,247 | 9/1964 | White | 200/153 S |

*Primary Examiner*—Henry K. Artis
*Attorney, Agent, or Firm*—Hall & Myers

[57] ABSTRACT

A power actuator for rotating and reversing a high power radio frequency switch is disclosed. The actuator uses a motor drive and a delay cam means to enable the transmitter's interlock switches to be opened or closed before the radio frequency switch is rotated. A manual drive means is provided to manually rotate the radio frequency switch and the interlock switches if desired. The delay cam includes a first cam means mounted on the shaft which drives the radio frequency switch. A second cam means which rotates freely on the same shaft is driven by a remotely controlled motor. The two cams are engaged, in the first embodiment, by an elongated pin which is fixed in the second cam and extends through an arcuate slot in the first cam. In the second embodiment, the arcuate slot cam means is replaced by a single pin which extends transversely through the first cam means drive shaft. This pin alternately engages at 90° angles the elongated pin fixed in the second cam, and a second arcuately spaced pin also fixed in the second cam. This elongated pin also engages the auxiliary switches which are arranged at either end of its limit of travel. The motor means drives the second cam through a friction clutch. When the motor is energized, the second cam begins to rotate, the elongated pin leaves the first set of auxiliary switches allowing them to go to their normally closed or open state. As it continues to rotate it engages the end of the slot in the first cam and rotates it and the radio frequency switch to its second position. As it reaches the second position, the elongated pin engages a second set of normally open or closed auxiliary switches and closes or opens them as desired in the interlock circuitry.

A reversing circuit for the motor is included to reverse the direction of rotation for the motor each time it is activated.

16 Claims, 16 Drawing Figures

POWER ACTUATOR FOR A COAXIAL R F POWER SWITCH

CROSS REFERENCE TO RELATED APPLICATION

This application is a continuation-in-part of my prior copending application Ser. No. 806,485, filed June 14, 1977, for Power Actuator For A Coaxial R F Power Switch and now abandoned.

BACKGROUND OF THE INVENTION

The present invention relates to an electric power actuator to provide for the rapid movement and precise positioning of a radio frequency high power switch element. These switch elements are used in coupling a plurality of transmitters or receivers to a plurality of antennas. A switch system using these switch elements must be able to handle relatively large power inputs and loads and must be capable of selectively switching from one power input to any one of a plurality of loads quickly and conveniently.

In particular, this power actuator is particularly adapted to be used with the "Radio Frequency Modular Switch System" described in U.S. Pat. No. 3,873,794 issued to Kenneth Owen on Mar. 25, 1975.

DESCRIPTION OF THE PRIOR ART

In the past, power actuation of R F switching systems has been achieved with costly, complex mechanisms which only partially met the basic requirements. Frequently they have been packaged in large and awkward assemblies. In most cases they require extensive modification of the switch element before they can be installed. In most cases, these prior art actuators have been relatively slow acting and required a very high level of operating power to achieve operating speed.

An example of this type of prior art actuator is disclosed in U.S. Pat. No. 3,584,172. This patent discloses an actuator which produces a reciprocating motion and auxilliary switching for motor control, interlock protection and electrical readout of only one position of the switch.

Another type of actuator is disclosed in U.S. Pat. No. 3,666,902. In this patent, a solenoid action is converted to rotary motion.

SUMMARY OF THE INVENTION

It is an object of the present invention to provide a power actuator for the remote control operation of a rotary electric switch of the type generally used as an element of "crosspoint" in a coaxial line switch matrix employed particularly in the radio frequency spectrum for the interchange or transfer of transmitters and antennas.

It is another object of the present invention to provide high-speed operation of the switch element with a very small amount of operating power.

It is another object of this invention to provide a means for remote control power operation of the switch element having a new and novel configuration for the motor drive and the interlock contact drive. The switch element also provides for plug transfer of all auxilliary switching functions, positive positioning stops, and a self-aligning output coupling shaft.

It is another object of the present invention to provide an actuator to perform an array of precise functions in a greatly simplified and compact structure having an exceptionally long life with very little need for periodic maintenance.

It is another object of the present invention to provide an actuator which can be installed in a matter of minutes to replace a manual operating knob without wiring or other changes or modifications to the switch matrix.

It is another object of the present invention to provide an actuator with a time delay between the time the auxiliary interlock switches function to shut down and protect equipment and the time the radio frequency power contacts begin to move toward the open condition.

It is another object of the present invention to provide an actuator which permits local, manual override by the station personnel for maintenance or for emergency purposes.

It is another object of the present invention to provide an actuator which has an indicator on the front of the case enclosure which gives instant visual indication to the local operator of the position of the radio frequency power switch element.

The present invention also provides remote indication for both switch positions and provides advance interlock protection for both the power source and the switch contacts.

DESCRIPTION OF THE FIRST EMBODIMENT

Figure 1:
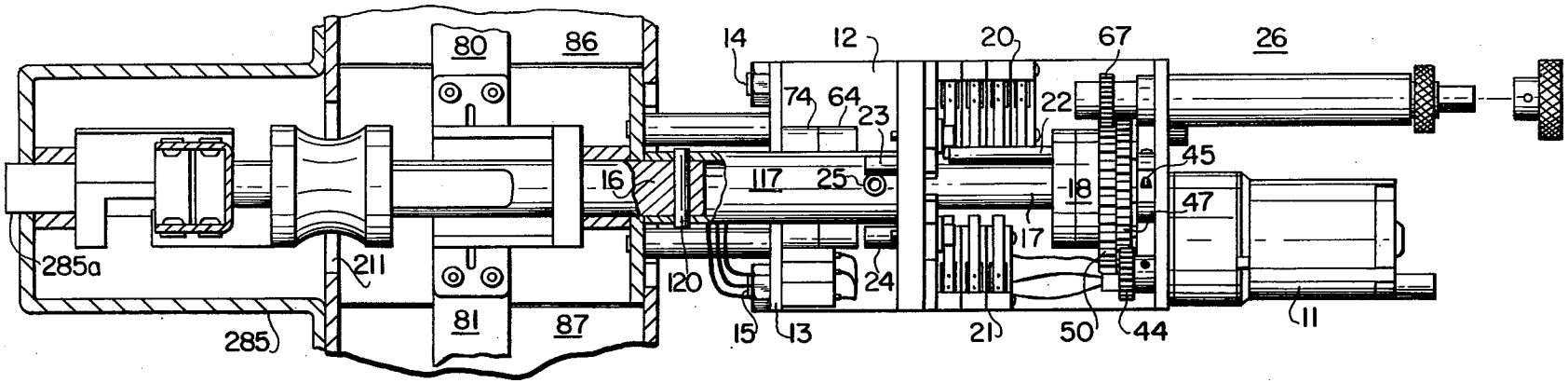
FIG. 1 is a partially crossectioned view of a high power R F coaxial switch with the power actuator mounted thereon.

FIG. 1 is a partially cross-sectional illustration of the power actuator of the present invention, and a high power R F switch. The high power R F switch will be hereinafter later described with respect to FIGS. 7, 8 and 9. The power actuator of FIG. 1 has its case removed and is mounted for operation.

As illustrated in FIG. 1, the power actuator includes a reversible motor means 11 which is mounted on the actuator frame 12 which is in turn secured to an auxiliary switch plate 13 of the R F power switch by mounting bolts 14 and 15. Motor means 11 drives the R F switch rotor 16 through the drive shaft 17, delay cam means 18, and the friction clutch means generally indicated at 19, which will be hereinafter later described. The actuator also includes a first set of auxiliary switches 20 and a second set of auxiliary switches 21 that are engaged by an auxiliary actuator pin 22.

In operation, the motor means 11 drives the R F power rotor 16 through a pre-determined angle of rotation. This angle of rotation is determined by indexing means 23 and 24 mounted on the actuator frame 12. As the rotor 16 and drive shaft 17 are rotating through said pre-determined angle of rotation, the interlock actuator pin 22 arrives as the first set of auxiliary switches 20 and opens or closes them. If the auxiliary switches are normally open, the actuator closes them, and if the auxiliary switches are normally closed, the actuator pin opens them.

Motor 11 is a reversing motor and will rotate in either direction depending on the polarity of the field applied to the motor. A reversing circuit, which will be hereinafter later described, is connected to one of the first set of auxiliary switches 20 and one of the second set of auxiliary switches 21 to automatically reverse the rotation of the motor after each cycle of operation. As will be hereinafer later described, the auxiliary actuator pin 22 rotates through a second larger pre-determined angle of rotation when motor 11 is energized. The difference in the respective angles of rotation are determined by the delay cam means 18, which is interposed between the motor means 11 and the coaxial switch 16. It allows the auxiliary actuator 22 to begin its angle of rotation before the angle of rotation is begun for the main rotor 15 and the drive shaft 17.

Figure 4:
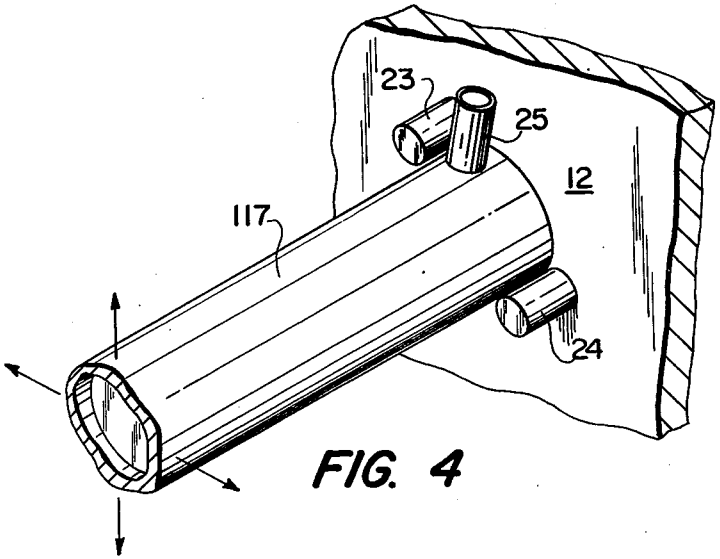
FIG. 4 is an isometric view of the drive shaft for the high frequency high power R F switch and the indexing means.

The indexing means for limiting the predetermined angle of rotation of the coaxial switch 16 is defined by stop pin 25 which is mounted on drive shaft 17 and index pins 23 and 24 which are mounted on the actuator frame 12. As more fully illustrated in FIG. 4, they define the limits of travel or rotation of the R F rotor 16 in the main switch.

A manual override means generally indicated at 26 is provided to manually rotate rotor 16 through its predetermined angle of travel for routine mantenance, or in the event of an emergency. The components of the manual override means will be hereinafter later described with respect to FIG. 2.

Figures 2, 3:
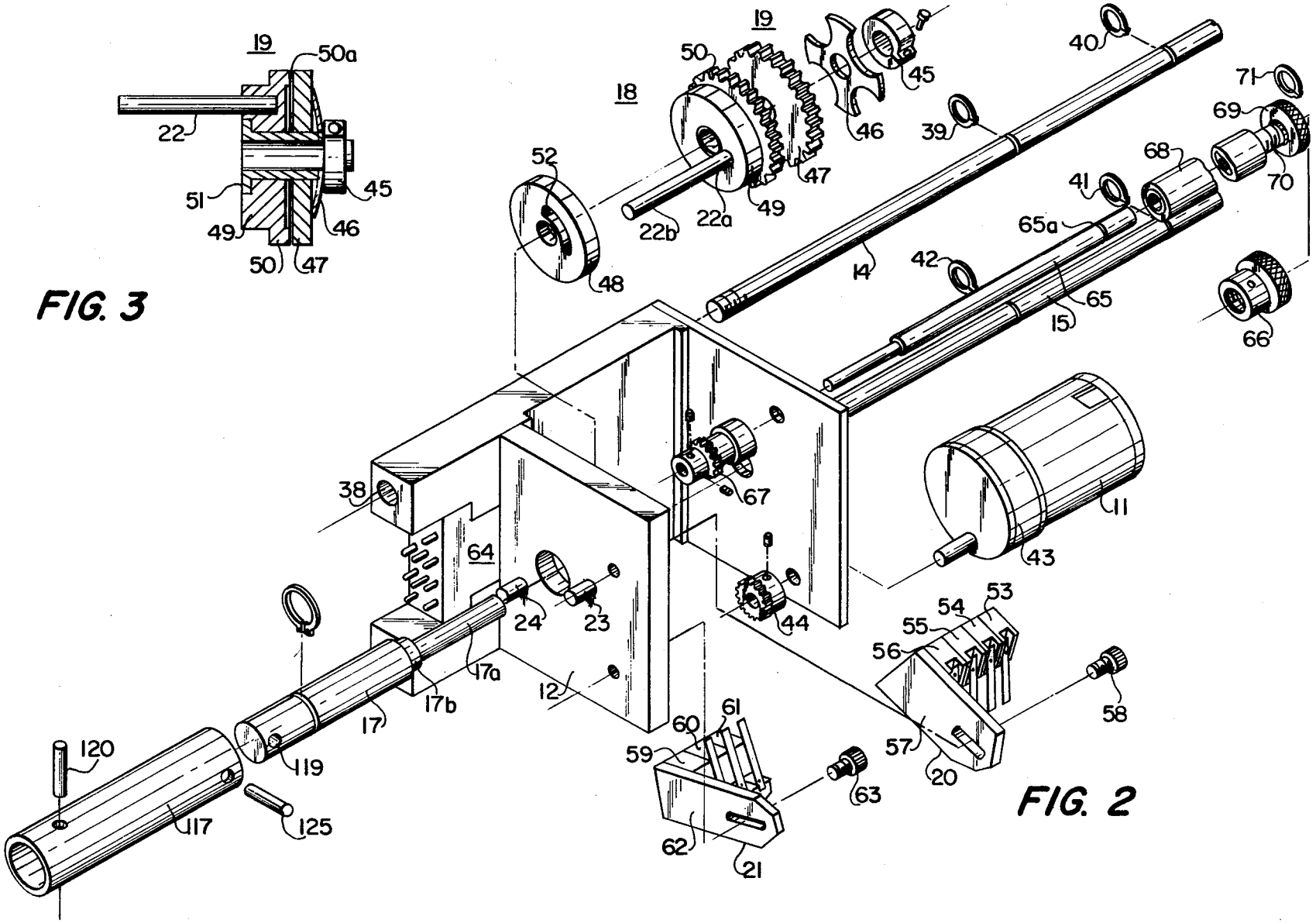
FIG. 2 is an exploded isometric view of the power actuator.
FIG. 3 is a crossection view of a protective friction clutch and the second cam member of the delay cam means.

FIG. 2 is an exploded view of the actuator of the present invention. The actuator frame 12 is mounted to the main frame 13 of the R F switch 16 by virtue of the mounting bolts 14 and 15 which extend through holes 37 and 38 (37 is visible only in FIG. 1) to secure the frame to the chasis of the high power R F switch. Both 14 and 15 are equipped with retainer clips 39 and 42 to provide load bearing surfaces by which the screws 14 and 15 secure the frame 12 to the main switch.

The motor means 11 drives the power actuator through a reduction gear assembly 43 and spur gear 44. Spur gear 44 engages a friction clutch drive means which includes clamp 45, spring 46, spur gear 47 and the delayed cam means 18, which includes first cam means 48, second cam means 49, and the interlock actuator pin 22.

In operation, spur gear 44 rotates spur gear 47, which is frictionally engaged with the second cam means 49 by means of spring 46. The completed assembly is illustrated in the FIG. 3. The second cam means 49 also defines a second spur gear 50 around the outer circumference of the cam means. As illustrated in FIG. 3, the entire assembly is held together by means of a collar 51 which is sized to freely rotate on drive shaft 17. Drive shaft 17 has a reduced diameter portion 17*a* for receiving the friction clutch means and portions of the delayed cam means.

The delayed cam means also includes the shaft 17 which rotates the coaxial line switch, and the first cam member 48 which is fixably mounted on cam 17 at 17*b*. First cam member 48 rotates the shaft when it is driven. The first cam means 48 defines an arcuate slot 52 which is concentric with the rotational axis of the shaft 17. The delayed cam means also includes a second cam member 49 which is mounted for free rotation on shaft 17 by means of collar 51. The second cam means defines a pin means 22 which engages the first cam member on either end of slot 52.

Elongated pin 22 serves two functions. At its base, 22*a*, it becomes a pin means which engages the first cam means 48 on either end of slot 52. Its extention 22*b* acts as an actuator for the first and second set of auxiliary switches 20 and 21.

The first set of interlock switches 20 includes four (4) switches 53, 54, 55 and 56 which are mounted on a frame 57 which is secured to the actuator chasis 12 by means of screw 58. The second set of actuator switches 21 includes switches 59, 60 and 61 which are mounted on frame 62 and secured to the chasis 12 by means of screw 63. As will be more fully explained hereinafter with respect to the FIG. 10, the switches 53–56 and 59–61 may be normally open or normally closed depending on the auxiliary circuitry required by the switch system. Switches 56 and 59 are normally closed micro-switches that are used in the reversing circuitry which provides for the automatic reversal of motor means 11 after each cycle of operation. The first and second set of auxiliary switches 20 and 21 are connected to the main switch systems through a block connector 64.

A manual override means 26 is provided to manually rotate the switch in the event of an emergency, or routine maintenance. The manual override means 26 includes a drive shaft 65 and a manual override knob 66 which is secured to the end of drive shaft 65. In operation, the rotation of knob 66 rotates shaft 65 which in turn rotates gear 67 which engages spur gear 50 defined on the outer surface of the second cam means 45. The manual override assembly also includes a collar means 68 which is the length of the cover (shown in FIG. 6) and is equipped with a knurled knob 69 which secures the cover (shown in FIG. 6) to the actuator frame 12. Collar 68 is externally threaded to receive knurled knob 69. Retainer clip 71 is mounted on shaft 65 at 65*a*.

The power actuator of the present invention also includes a universal joint feature to provide for the rotation of the main R F switch even though there may be a slight misalignment of the actuator and switch frame. Shaft 17 drives collar 117 by means of pin 25 which extends through the collar and a hole 119 defined in the end of shaft 117. Collar 117 is secured to the main switch rotor 16 by means of pin 120. Pins 25 and 120 are disposed at right angles to one another. Collar 117 is sized to provide a loose fit over shaft 17 and switch rotor 16. This loose fit and the 90 degree positioning of pins 118 and 120 provide a rudimentary universal joint between shaft 17 and switch rotor 16.

Operation of the First Embodiment

Figure 5:
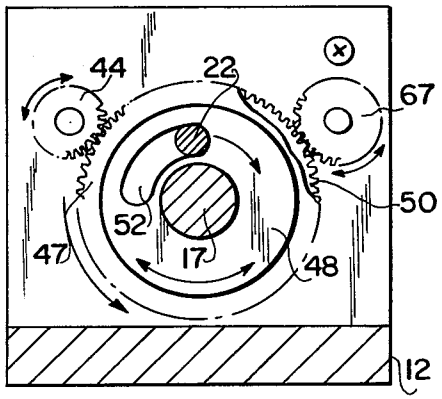
FIG. 5 is a partially crossectioned view taken along section lines 5—5 of FIG. 1.

The operation of the first embodiment will now be described with respect to FIGS. 1, 3, 4 and 5. When motor means 11 is energized, it begins to drive spur gear 44 which in turn rotates spur gear 47 in the opposite direction. As spur gear 47 is rotated, it frictionally engages the second cam 49 by virtue of surface 50*a* illustrated in FIG. 3. The amount of frictional engagement is defined by the tension of spring 46 and the surface area of the raised portion 50*a*. As member 50 rotates, the interlock actuator pin 22 begins to rotate counter clockwise as illustrated in FIG. 5. As it begins its rotation, it releases the first set of auxiliary switches 20 (shown in FIG. 1) and continues its rotation until it engages the opposite end of slot 52 defined in the first cam member 48. Thereafter second cam member 49 drives the first cam member 48 and shaft 17 through the pre-determined angle of rotation.

The predetermined angle of rotation is determined by index pins 23 and 24 which are mounted on the main actuator frame 12. They are engaged by stop pin means 25. The precise location of pins 23 and 24 determines a precise angle of rotation for rotor 16 and insures its positive and exact alignment with its respective switch contact points.

From beginning of actuation to its termination, a switch cycle in both embodiments takes approximately 0.2 of one second. Since motor 11 rotates at a high speed, its inertia continues to drive the gear train, clutch, and cam means after its field has been de-energized. This insures exact and positive positioning of shaft 17.

In the first and second embodiments the interlock actuator pin 22 will engage one of the sets of interlock switches before the stop pin 25 engages index pin 23 or 24. As the interlock actuator engages the interlock switches, it will open one of the normally closed switches 56 or 59, (depending on the direction of rotation) which will then terminate the electrical field applied to motor 11. The rotating mass of motor 11, reduction gear 43, clutch 19, and cam means 18 provides enough inertia to continue to rotate drive shaft 17 in its direction of rotation and thereby secure stop pin 25 against one of the index means 23 or 24.

The operation of the interlock circuitry and of the automatic reversing circuit for motor means 11 will be hereinafter described with respect to FIG. 10.

Figure 6:
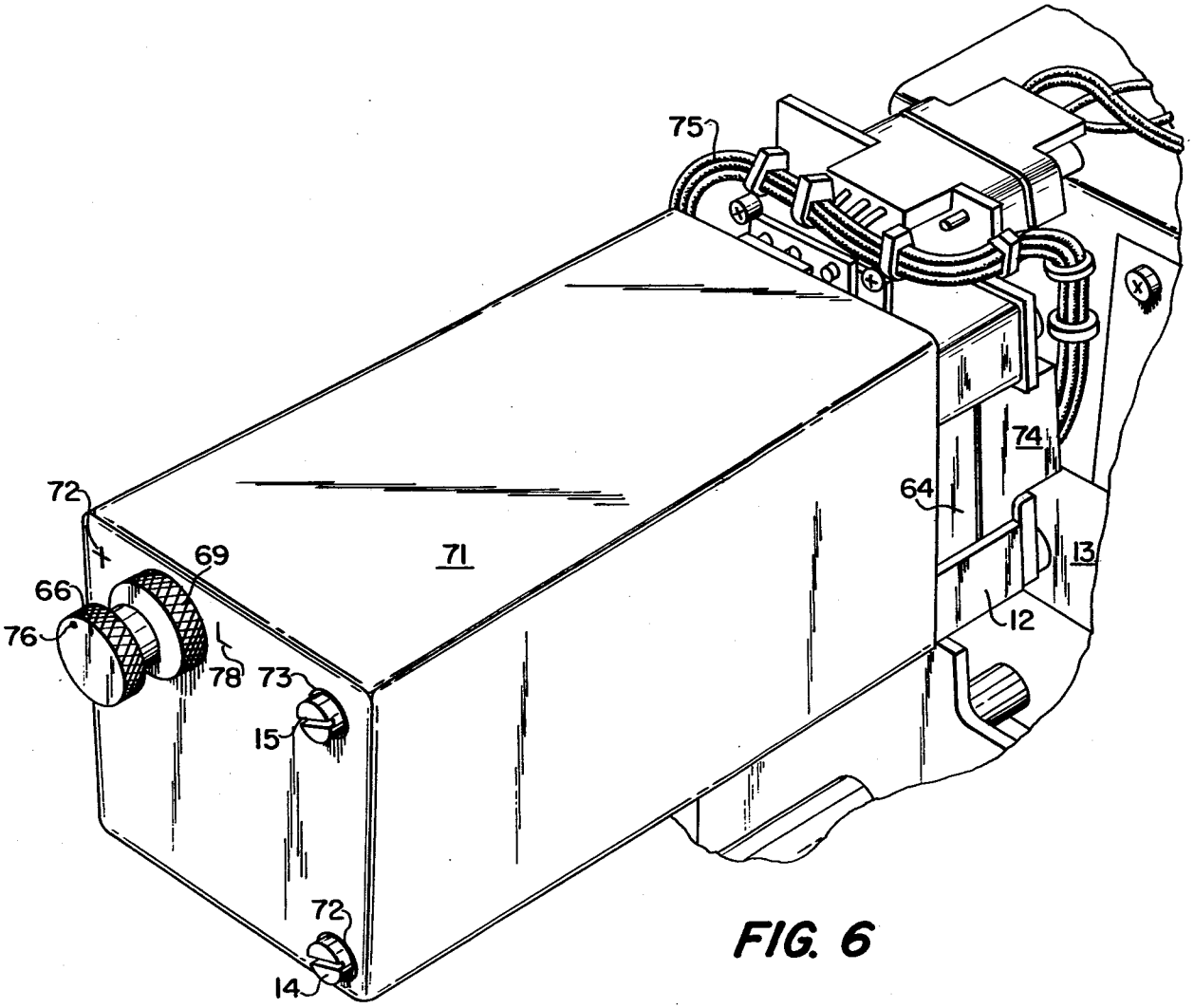
FIG. 6 is an isometric view of the power actuator with the cover case and portions of the switch matrix removed.

FIG. 6 is an isometric view of the power actuator of the present invention with two of the face plates of the switch matrix removed. The power actuator is provided with a cover 71 which is secured in place by knurled nut 69. Holes 72 and 73 are provided for screws 14 and 15 which secure the main frame 12 to the auxiliary switch plate 13. A connector block 74 connects to the power actuator connector block 64 to carry the auxiliary circuitry from the power actuator through the wiring harness 75. The wiring harness interconnects all of the various switch modules and power actuators and is in turn connected to a remote switch means for energizing each of the motors of the power actuators. A remote indicating means is also incorporated in the wiring circuitry to provide a remote indication of the position of the rotor. A local visual readout is also possible by looking at the power actuator for each cross point. A dot indicia 76 is provided on the knurled knob 66 to indicate the internal position of rotor 16. If the indicia 76 is aligned with indicia 77, the crosspoint is in a through connect position and no cross contact is made. If, however, the indicia 76 is aligned with indicia 78 the crosspoint is in an interconnect relationship connecting one of the transmitter lines with one of the antennas. The precise positioning of indicia 76 is achieved by matching the ratio of spur gears 67 and 50 to the rotational travel of pin 25 between index pins 23 and 24.

Description of the Second Embodiment

Figure 11:
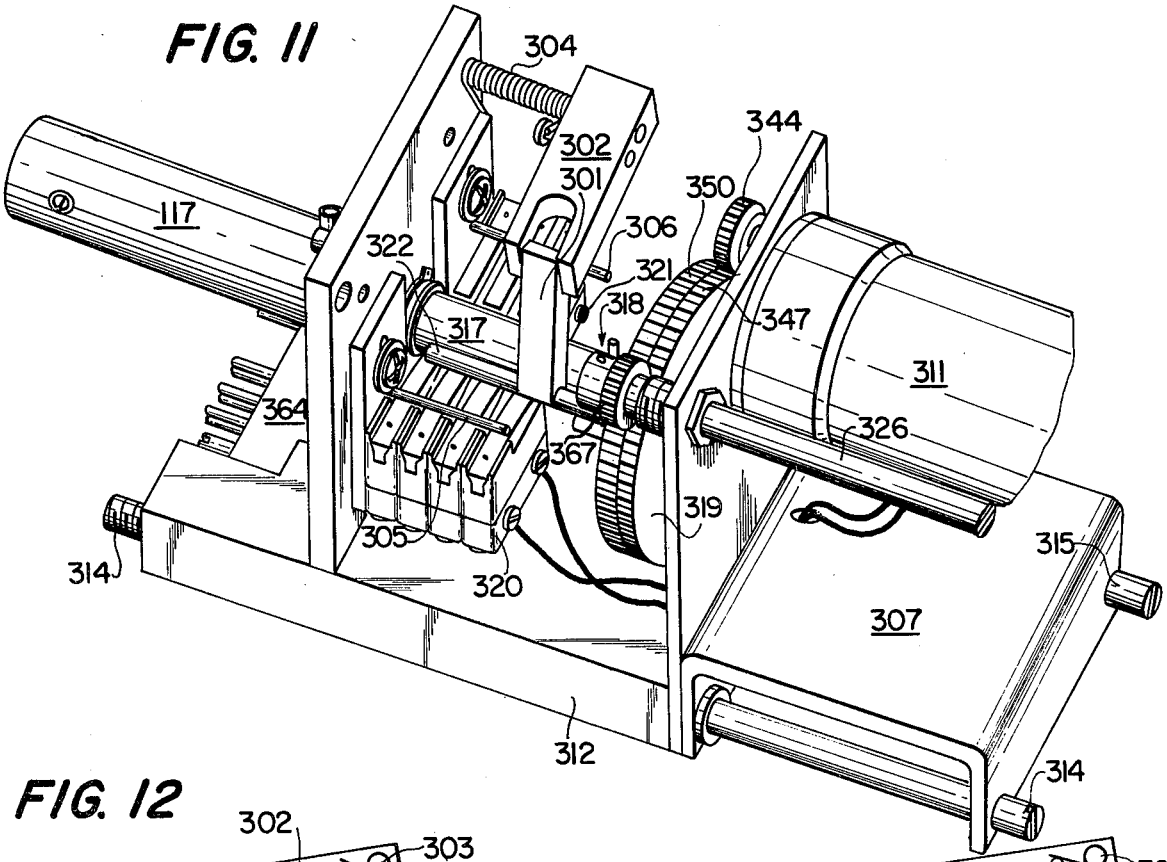
FIG. 11 is an isometric view of a second embodiment of the invention.

FIG. 11 is an isometric illustration of the power actuator of the present invention. As illustrated in FIG. 11, the power actuator includes a reversible motor means 311 which is mounted on the actuator frame 312 which is in turn secured to an auxiliary switch plate of an R F power switch by mounting bolts 314 and 315 (not shown). Motor means 311 drives the R F switch rotor 16 through the drive shaft 317 delay cam means 318 and the friction clutch means generally indicated at 319. The friction clutch means 319 functions in a manner identical to that of friction clutch 19 previously described. The actuator also includes a first set of auxiliary switches 320 and a second set of auxiliary switches 321 that are engaged by an auxiliary actuator pin 322.

In operation, the motor means 311 drives the R F power rotor through a predetermined angle of rotation. This angle of rotation is determined by indexing means 23 and 24 which are mounted on the actuator frame (see FIG. 2). As the rotor 16 and drive shaft 317 are rotating through said predetermined angle of rotation the interlock actuator pin 322 arrives at the first set of auxiliary switches 320 and opens or closes them. If the auxiliary switches are normally open, the actuator closes them, and if the auxiliary switches are normally closed, the actuator pin opens them.

Motor 311 is a reversing motor and will rotate in either direction depending on the polarity of the field applied to the motor. A reversing circuit, which will be hereinafter described, is connected to one of the first set of auxiliary switches 320 and to one of the second set of auxiliary switches 321 to automatically reverse the rotation of the motor after each cycle of operation. As will be hereinafter described, the auxiliary actuator pin 322 rotates through a second larger predetermined angle of rotation when motor 311 is energized. The difference in respective angles of rotation is determined by delay cam means 318 which is interposed between the motor means 311 and the coaxial switch 16. It allows the auxiliary actuator pin 322 to begin its angle of rotation before the angle of rotation is begun for the main rotor 16 and drive shaft 317.

Figure 15:
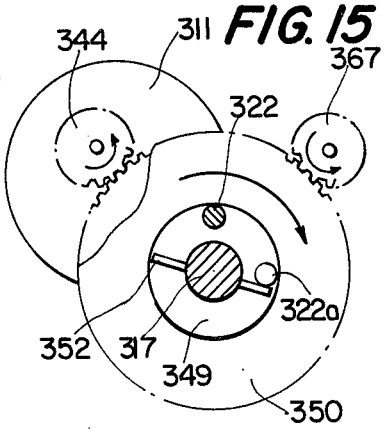
FIG. 15 is a second partially cross-sectioned and diagrammatical view of the interaction between the first and second cam means.
Figure 16:
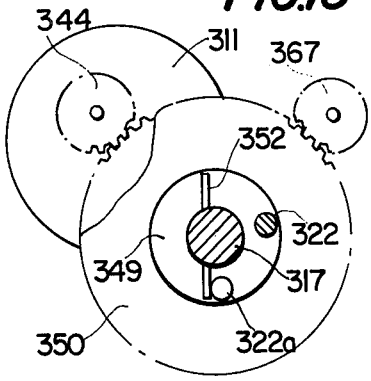
FIG. 16 is a third partially cross-sectioned and diagrammatical view of the interaction between the first and second cam means.

In the first embodiment, the respective angles of rotation were determined by actuator pin 22 and the arcuate slot 52 defined by the first cam means. In the second embodiment of the invention, the configuration of the cam means is altered and is best illustrated in FIGS. 14 through 16.

Figure 14:
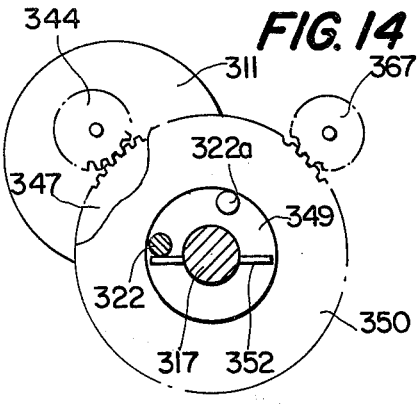
FIG. 14 is a partially cross-sectioned and diagrammatical view of the interaction between the first and second cam means.

In FIG. 14, the actuator and cam means is at rest with the auxiliary actuator pin 322 engaging the auxiliary actuator switches 321 (not shown in FIG. 14). When motor means 311 is energized, it drives the friction clutch means 319 in a generally clockwise direction as illustrated in FIG. 14. Friction clutch 319 includes 347 and 350 which both rotate in a clockwise direction. Mounted on member 350 or formed integrally therewith is boss means 349 which has fixed therein auxiliary actuator pin 322 and a stud pin 322*a*. As motor 311 rotates, both the auxiliary actuator pin 322 and the stud pin 322*a* are rotated in a clockwise direction to the point illustrated in FIG. 15. When these two pins are rotated through approximately 75° of travel, they strike a transversely mounted pin 352 which extends through shaft 317. As motor means 311 and stud means 322*a* continue to rotate in a clockwise direction they drive shaft 317 in a clockwise direction thereby rotating the main switch rotor 16. When the rotation has reached the angle illustrated in FIG. 16, the auxiliary actuator pin 322 has engaged the auxiliary contact switches 320 which de-energize motor 311. At the same time, shaft 317 has been rotated 90° bringing the indexing pin 125 into engagement with the switch pin indexing means 23 and 24. The main switch rotor has rotated through exactly 90° of rotation.

When it is desired to reverse the rotation of the switch, motor 311 is energized to rotate in the opposite direction which in turn rotates boss means 349 and the pins 322 and 322*a* in a counter-clockwise direction. As pin 322 begins its angle of rotation in a counter-clockwise direction, it leaves the auxiliary switch means 320 thereby activating the auxiliary contact switches 320 to shut down the transmitter and reverse the motor reversing circuit which will be hereinafter described. After the auxiliary actuator pin 322 has traveled through approximately 90° of rotation, it will strike the transversely mounted pin 352 and begin to rotate it in a counter-clockwise direction thereby rotating shaft 317 and the main switch rotor 316. When it arrives at the position illustrated in FIG. 14, the auxiliary actuator pin 322 will have traveled 180°, and shaft 317 will have traveled 90°. Concurrently therewith, the auxiliary switch means 320 will have been actuated as pin 320 began its angle of rotation and auxiliary switch means 321 will have been actuated as pin means 322 completed its angle of rotation. In the interim, main switch rotor 16 will have been rotated through 90° of rotation.

The primary difference between the first and second embodiments lies in the construction of the delay cam means. A secondary difference involves a vibration inhibiting means generally illustrated in FIGS. 12 and 13. This means is used when the switch rotor and the R F power switches are used in mobile applications such as ships, trucks and airplanes. The means illustrated in FIG. 12 and 13 provide a positive spring loaded bias to hold the switch rotor 16 at either end of its direction of travel.

Figure 12:
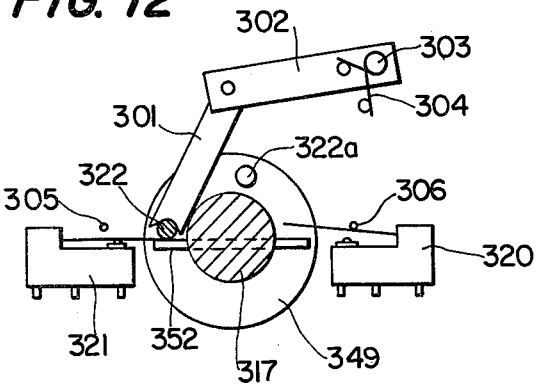
FIG. 12 is a partially cross-sectional and diagrammatical view of a vibration inhibiting feature of the second embodiment in its first state.

As illustrated in FIG. 12, auxiliary actuator pin 322 is held in firm engagement with the auxiliary switch means 321 by means of a lazy link 301 and 302. Lazy link arm 302 is arranged for rotation about pivot point 303 and spring loaded to be driven in a downward direction as illustrated in FIG. 12 by spring means 304. As arm 302 is urged in a downward direction by spring means 304, it forces link arm 301 into engagement with the auxiliary actuator pin 322. Auxiliary actuator pin 322 is also held in spring loaded engagement with pin 352. Pin 352 and shaft 317 are likewise held in spring loaded engagement with the indexing means firmly engaged against stop means 24. The means that the main switch rotor 316 is held in a spring loaded engagement at the end of its 90° of rotation.

Figure 13:
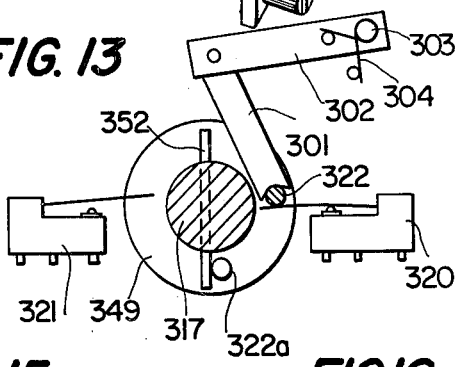
FIG. 13 is a partially cross-sectional and diagrammatical view of a vibration inhibiting feature of the second embodiment in its second state.

When it is desired to reverse the rotation of the switch, motor means 311 is energized and the auxiliary actuator pin 322 is driven in a clockwise direction thereby raising lazy link 301 and 302 over center to the position illustrated in FIG. 13. During the first 90° of rotation, motor 311 is resisted in its rotation by means of a spring 304, while during the second 90° of rotation it is aided by spring means 304. When actuator pin 322 has reached the position illustrated in FIG. 13, it has energized the actuator switches 320 and is held in spring loaded engagement therewith by means of spring means 304 and lazy link 301 and 302. In addition a pair of safety pins 305 and 306 are included in the second embodiment of the invention to prevent the auxiliary contact switches 320 and 321 from traveling too far and interfering with the movement of auxiliary actuator pin 322.

The indexing means for limiting the predetermined angle of rotation of the coaxial switch 16 is defined by stop pin 25 which is mounted on drive shaft 17 and index pins 23 and 24 as hereinbefore described with respect to the first embodiment. The manual override means generally indicated at 326 is also the same for the second embodiment as was for the first.

In the second embodiment of the invention, an additional frame means 307 is added to frame means 312. Frame means 307 provides for secure engagement of the motor casing illustrated in FIG. 6. The manual override means 326 extend through the casing as illustrated in FIG. 6 and terminates in knob 66 to provide for manual rotation of switch rotor 16. Mounting bolts 314 and 315 extend through the casing illustrated in FIG. 6 as do bolts 14 and 15 in the first embodiment.

The operation of the interlock switch circuits and the interlock switch meanse 320 and 321 is the same with respect to the second embodiment as will be hereinafter described with respect to the first embodiment for switches 20 and 21. The operation of the friction clutch 319 and the frictional engagement of members 347 and 350 is the same as was previously described with respect to the first embodiment for members 47 and 50. The plug-in switch means 364 is also the same with respect to the second embodiment as for the first.

The U-joint coupling 117 which couples drive shaft 317 with switch rotor 16 is the same as was hereinbefore described for the first embodiment.

APPLICATION OF THE INVENTION

The power actuator of the present invention is intended to be used with a high power radio frequency electric switch that may be used singly, or in a matrix configuraton to interconnect any one of a number of coaxial input lines to any one of a number of coaxial output lines. This type of switch system is mroe fully descirbed in my previous U.S. Pat. No. 3,873,794 entitled "Radio Frequency Modular Switch System". This kind of switch system provides an interconnection within the matrix at any desired crosspoint while simultaneously grounding inactive strip line sections which would float within the system and arc or flash over to ground in the event of self resonance. These switch systems also provide mechanical and electrical interlocks to prevent the interconnection of more than one output section to any given input section or more than one input section to any given output section. The electrical interlock means also provides for shut down of the transmitter before the main power switch rotor is rotated when the field antenna is changed.

Figure 8:
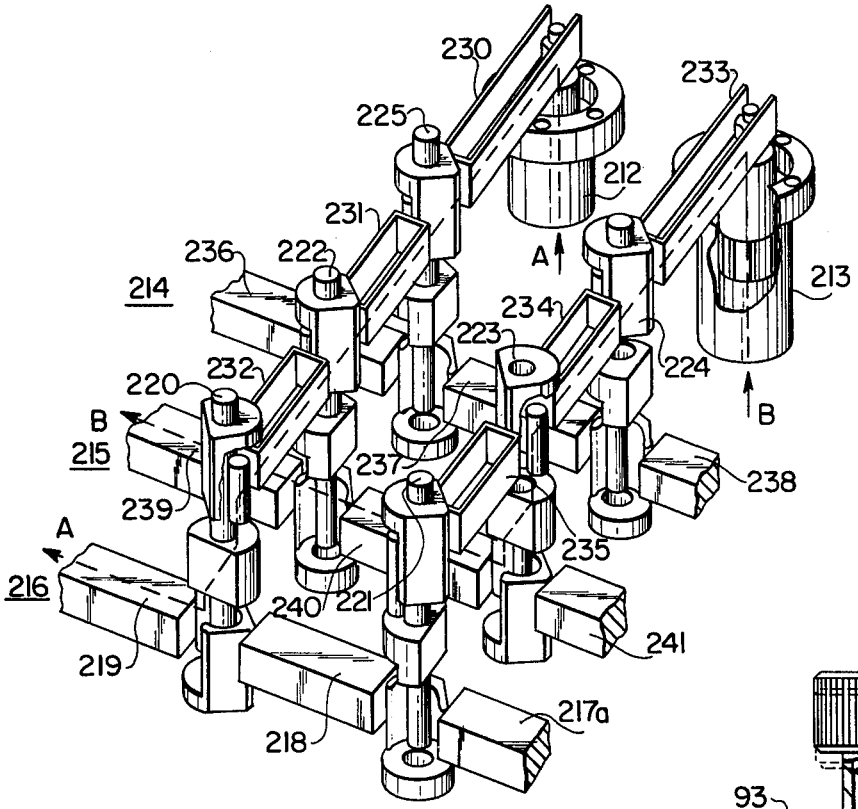
FIG. 8 is a diagrammatical and isometric view illustrating the configuration and operating of a matrix switch system and its rotary contactor.

The cross over matrix, the line sections, and the rotatable contactors are illustrated diagrammatically in FIG. 8. A transmitter input line 212 is fed to a plurality of strip line sections 230–232. A coaxial input line 13 is fed to a plurality of strip line sections 233, 234, and 235.

Similarly, the output line sections are also associated with a plurality of strip line sections with output line 214 being associated with strip line sections 236, 237, and 238. Output line 215 is associated with strip line sections 239, 240, and 241 while output line 216 is associated with strip line sections 217*a*, 218 and 219.

Two signal paths are illustrated by dotted lines in FIG. 8. The first is illustrated by dotted line A and the second by dotted line B.

As illustrated, the incoming signal present on coaxial input 212 is fed through input strip line section 230, rotary contactor 225, strip line section 231, rotary contactor 222, strip line section 232, and rotary contactor 220. Rotary contactor 220 has been moved from a through connect position to an interconnect or "cross-connect" position and electrical contact is made between the strip line section 232 and output line section 219 of the output line 216. This connection is established through the single cross connect contact means 28 which is mounted on the rotary contactor 220.

Similarly, the input line signal present on coaxial line 213 is transferred down strip line section 233, rotary contactor 224, strip line section 234, to rotary contactor 223. The signal is then interconnected to output line 215 through rotary contactor 223 and strip line section 40. The signal then passes from strip line section 240 through rotary contactor 222 to stripline section 239.

Each of the rotary contact members 220–225 has a first and second rotary position. In the first rotary position they establish through connections between the strip connectors, and in the second rotary position they establish transverse connections which interconnect the input and output lines.

Figure 9:
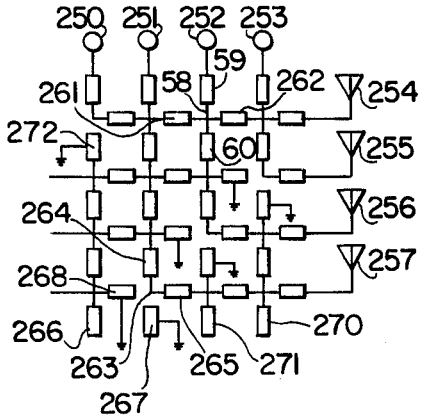
FIG. 9 is an electrical schematic view of the switch matrix illustrated in FIG. 8.

This is illustrated schematically in FIG. 9 where transmitter 250 is interconnected with antenna 254. Transmitter 251 is interconnected with antenna 257, transmitter 252 is interconnected with antenna 256, and transmitter 253 is interconnected with antenna 255. The cross over indicated at 258 refers to a through connection between the strip line sections 259 and 260 and a second through connection between strip line sections 261 and 262. At that point in the matrix, the rotary contactor positioned between strip line sections 259–262 is turned to its "through" position. The upper portion (represented by through connector 222b on rotor 222) is establishing contact between strip line sections 261 and 262.

The interconnect or cross connect is illustrated at 263. In this position, the rotary contactor 263 has been turned to its interconnect position. In this position, electrical contact has been made between transmitter 251 and antenna 257 by the interconnect contact (illustrated as 228 on rotor 220). Strip line section 264 is electrically connected to strip line section 265 by means of the interconnect contact 228. Each of the inactive strip line sections remaining after an interconnection (illustrated by numerals 266, 267, 268, 270 and 271) is grounded.

The construction of the rotary contactor makes it impossible to have both a through connect and an interconnect position at the same time. Thus when an interconnection is made, it breaks the through connect which was previously established. Thus, when transmitter 250 is connected to line 254, it becomes impossible to interconnect it with any of the other antennas since the connection is broken as illustrated at 272. If one were to turn rotary contact 258 from its through position to its interconnect position, it would interconnect transmitter 252 with antenna 254, but would simultaneously disconnect transmitter 250 from the strip line leading to antenna 254. Thus the design and construction of the rotary contactor means makes it impossible to have more than one input line feeding into an output line, or more than one output line receiving signals from a single input line. An inadvertent choice on the part of the operator may select the improper antenna for a given transmitter, but it will not impose the load of two transmitters onto a single line. Similarly, an inadvertent choice in the selection of antennas, will result only in the selection of an improper antenna, and will not result in the imposition of two antennas upon a single transmitter.

Figure 7:
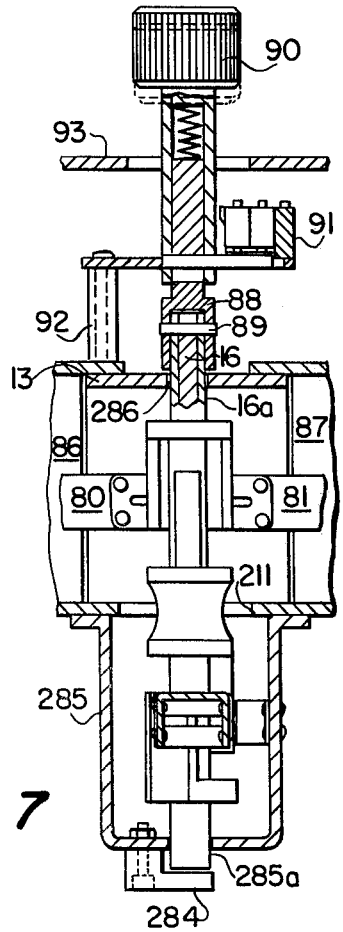
FIG. 7 is a partially crossectioned view of a manually operated rotary contactor used in high power R F switch.

The coaxial line switch rotor used in these matrix switch systems is more fully illustrated with respect to FIG. 7. The rotary contactor is mounted within inter-rotor contact housing 285 and frame member 13. These coxial switch rotors are mounted at any given cross over of input and output lines and they establish through connections or cross connections depending upon their orientation. In FIG. 7, the input strip line section is generally indicated with numeral 80 and the output line section indicated with the numeral 81. The rotor itself has a central shaft 16 with a metal core and a teflon sheath 16*a* for R F insulation. The shaft extends through an opening 211 in the base plate and rests on retaining means 284 which is bolted to the inter-rotor contact housing 285. Each of the strip line sections 80 and 81 is housed within a coaxial line section 86 (for strip line 80) and 87 (for strip line 81). The rotor shaft 15 extends through openings 285*a* defined in the inter-rotor contact housing and 286*a* defined in the frame member 13. The upper end of shaft 16 is fixably secured to a shaft extension 88 by means of pin 89. The shaft extension and pin 89 are used for manual rotation of the switch rotor by means of knob 90 during manual operation. A set of interlock switches 91 is also attached to frame means 13 by means of spacer 92. A face plate 93 is provided within the manually operated switch matrix to enclose the matrix and to protect the interlock swtiches 91.

When it is desired to install a power actuator for the coaxial line switch rotor, the face plate 93 is removed. One of the auxiliary switch brackets is moved to allow pin 89 to be removed along with the manual actuator knob 90.

The manual auxiliary switch bracket is then reinstalled in its original position. The power actuator is then installed with the two screws 14 and 15. They screw into nuts 14*a* and 15*a* which are attached to the bottom of the auxiliary switch plate 13. As the actuator is placed into position, connector block 64 in the actuator engages connector block 74 mounted in the auxiliary switch plate 13. Pin 120 (FIG. 1) then replaces pin 89 for accurate rotational positioning, and the installation is complete.

Figure 10:
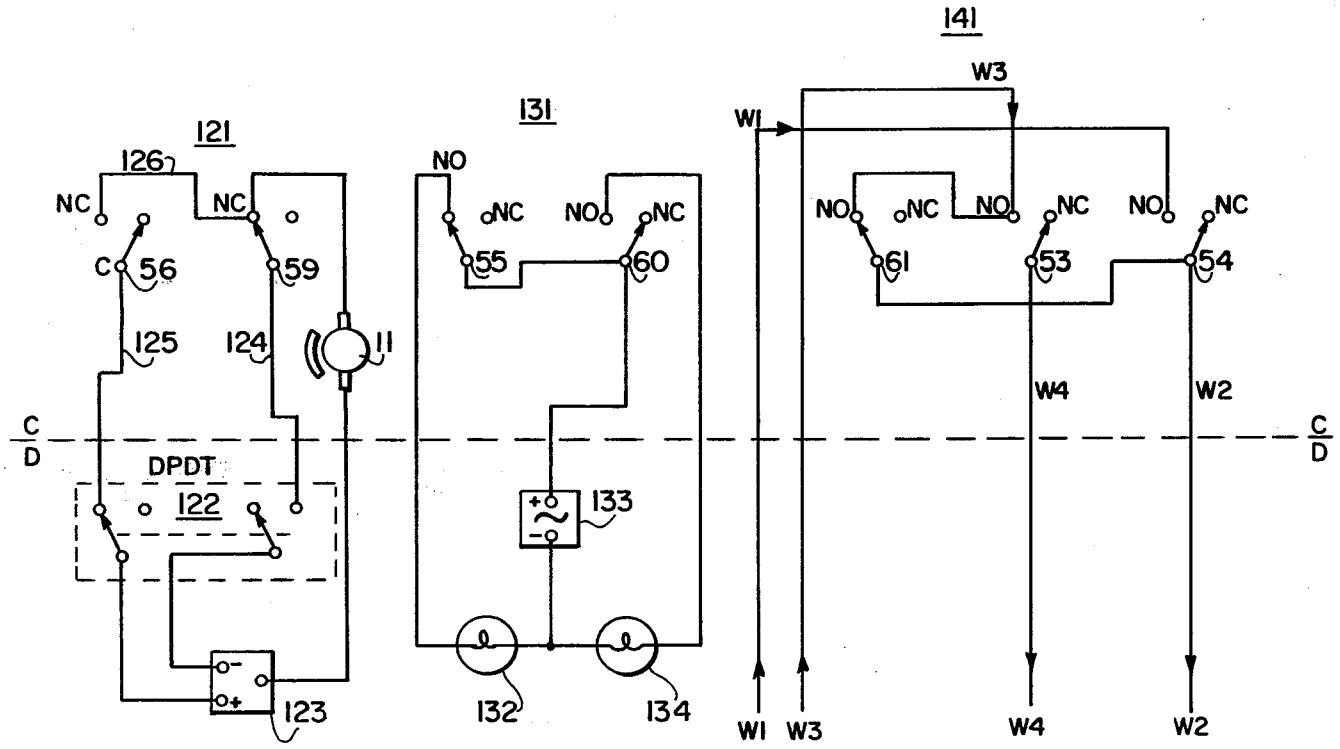
FIG. 10 is an electrical schematic view of the auxiliary circuitry of the present invention.

The interlock and motor reversing circuitry of the invention is more fully described with respect to the electrical schematic drawing illustrated in FIG. 10. The auxiliary switches of the present invention include three distinct groups of switches and switch functions. The first group of switches, illustrated in circuit 121, relate to the motor-reversing circuitry. The second group of switches, illustrated in circuit 131 relate to an indicating circuit. The third group of switches, illustrated in circuit 141 relate to the transmitter interlock switches. A dotted line through the middle of the schematic is shown to illustrate the division between connector block 64 and connector block 74. All circuitry on the c-c side of the dotted line refers to circuits in the power actuator. All circuits described on the d-d side of the dotted line are external to the actuator.

The automatic reversing circuitry is illustrated with respect to circuit 121. Micro-switch 66 is found in the first set of auxiliary switches 20, while micro-switch 59 is found in the second set of auxiliary switches 21. Double pole, double throw switch 122 is external of the power actuator and is used to initiate each operation of the actuator. In the position illustrated in FIG. 10, the circuit is at rest after having completed a cycle of operation. When switch 122 is thrown, rotor 11 is energized by the DC motor power supply 123. The initial energization takes place through circuit 124 and micro-switch 59. As rotor 11 begins to turn, the auxiliary actuator will begin to rise from micro-switch 56. When it is fully disengaged, micro-switch 56 will return to its normally closed state and circuit 125 will be interconnected with circuit 126. Meanwhile motor 11 will continue to turn until the auxiliary actuator bar reaches micro-switch 59 and opens it. At that point, the electrical field or motor 11 is de-energized and switches 56, 59 and 122 are in their opposite state from that illustrated in circuit 121. The system will then rest until the double pole double throw switch 122 is returned to the position illustrated in FIG. 121. At that point, the polarity on DC motor 11 will be reversed, and the motor will begin to operate in the opposite direction through circuit 125 and 126. As the auxiliary actuator bar leaves micro-switch 59 it will return to the position illustrated in FIG. 121. The circuit will continue to energize motor 11 until the auxiliary actuator bar arrives at micro-switch 56 and opens the normally closed switch.

Circuit 131 is a remote indicator circuit that indicates which position the main switch rotor is in. As illustrated in FIG. 10, micro-switches 55 and 60 are normally open switches that are closed by the auxiliary actuator bay 122. Micro-switch 55 is contained in the first set of micro-switches 20, while micro-switch 60 is in the second set of micro-switches 21. As illustrated in FIG. 10, the auxiliary actuator has energized the first set of micro-switches 20 and micro-switch 55 has been closed by the auxiliary actuator arm. Signal light 132 is powered by the AC lamp source 133. When the auxiliary actuator arm leaves the first set of micro-switches 20, lamp 132 will extinguish and when the auxiliary actuator arm arrives at the second set of micro-switches, switch 60 will be closed and indicator lamp 134 will glow.

The circuit illustrated at 141 is the interlock circuit provided for the transmitter interlock. When heavy R.F. loads are switched, it is necessary for the transmitter to be shut down before the load is removed from the transmitter's final stage. Severe damage will result to the transmitter if the antenna load is removed while the final stage is still under power. Therefore, interlock switches are provided to shut down the final stage of the transmitter before the transmitter load is removed. These interlock switches are designated at 53, 54 and 61 in FIG. 10. As illustrated in circuit 141, W-1 represents a circuit from the actuator to the left of the present module or if there were no module on the left side of this crosspoint, there would be no connection. Circuit W-2 would return to the transmitter interlock return or if there is an actuator on the right of the crosspoint to that actuator inerlock. Circuit W-3 would be from the transmitter interlock circuitry, or in the event there is an interlock above this crosspoint, it would go to the crosspoint above. The circuit W-4 would extend to the actuator below this crosspoint, or there would be no connection.

It is readily apparent that either normally open or normally closed switches could be used in the auxiliary circuitry depending upon the design configuration of the remaining circuits. It should also be noted that while applicant has described the preferred embodiments of the present invention, other variations will be suggested to those skilled in the art. It must, therefore, be understood that the foregoing description is meant to be illustrative only and not limitative of the present invention, and all such variations and modifications as are in accord with the principles described therein are meant to fall within the scope of the appendant claims.

I claim:

1. A power actuator for a coaxial line switch, said actuator comprising:

(a) reversible motor means for intermitently driving and then reversing a coaxial line switch through a predetermined angle of rotation;

(b) reversible auxiliary actuator means driven by said motor means through a second predetermined angle of rotation;

(c) delay cam means interposed between said motor means and said coaxial switch means whereby said auxiliary actuator begins its rotation before said coaxial switch means begins to rotate;

(d) first and second sets of auxiliary switch means engaged by said auxiliary actuator means, with said first set actuated as actuator begins its angle of rotation, and said second set actuated as said actuator ends its rotation.

2. A power actuator for a coaxial line switch as claimed in claim 1 which further includes a remote switch means for energizing the motor means of said power actuator.

3. A power actuator for a coaxial line switch as claimed in claim 1 which further includes circuit means connecting said first and second sets of auxiliary switch means and said reversing motor means to provide automatic reversal of said motor each time said power actuator is operated.

4. A power actuator for a coaxial line switch as claimed in claim 3 wherein said motor means and said delay cam means define a rotational mass that develops inertia which drives said coaxial line switch closed after said motor means is de-energized.

5. A power actuator for a coaxial line switch as claimed in claim 1 which further includes a manual operating means which engages said delay cam means to rotate said coaxial line switch and said auxiliary actuator through their respective first and second angles of rotation.

6. A power actuator for a coaxial line switch as claimed in claim 1 whereby said delay cam means comprises:

(a) a shaft for rotating said coaxial line switch;

(b) a first cam member fixedly mounted on said shaft, said member defining an arcuate slot concentric with the rotational axis of said shaft;

(c) a second cam member mounted for free rotaton on said shaft, said second cam means defining a pin means which engages said first cam member at either end of the arcuate slot.

7. A power actuator for a coaxial line switch as claimed in claim 6 wherein said auxiliary actuator defines an extension of the pin extending through said first cam member.

8. A power actuator for a coaxial line switch as claimed in claim 7 which further includes a friction clutch drive means, said friction clutch means including:

(a) a gear means mounted for free rotation on said shaft, said gear means being driven by said motor means;

(b) spring means for driving said gear means into frictional engagement with said second cam means whereby said second cam means is frictionally driven by said gear means and said motor means.

9. A power actuator as claimed in claim 8 which further includes a manual actuator for rotating said second cam member.

10. A power actuator as claimed in claim 7 wherein said first set of auxiliary switches are normally open or normally closed, but are retained in the opposite position until said pin means begins to rotate and said second set of auxiliary switches may be normally open or normally closed, but are retained in the opposite position when said pin means concludes its angle of rotation.

11. A power actuator for a coaxial line switch as claimed in claim 1 wherein said delay cam means comprises:

(a) a shaft for rotating said coaxial line switch;

(b) a transversely mounted cam means fixedly mounted on said shaft to extend on either side of said shaft;

(c) a second cam member mounted for free rotation on said shaft, said second cam means defining a pin means which engages said transversely mounted cam means on either side of said shaft.

12. A power actuator for a coaxial line switch as claimed in claim 11 wherein said transversely mounted cam means defines an elongated pin which extends through said shaft to extend to either side of said shaft.

13. A power actuator for a coaxial line switch as claimed in claim 11 which further includes a friction clutch drive means, said friction clutch means including:

(a) a gear means mounted for free rotation on said shaft, said gear means being driven by said motor means;

(b) spring means for driving said gear means into frictional engagement with said second cam means whereby said second cam means is frictionally driven by said gear means and said motor means.

14. A power actuator as claimed in claim 12 which further includes a manual actuator for rotating said second cam member.

15. A power actuator as claimed in claim 13 wherein said first set of auxiliary switches are normally open or normally closed, but are retained in the opposite position until said pin means begins to rotate and said second set of auxiliary switches may be normally open or normally closed, but are retained in the opposite position when said pin means concludes its angle of rotation.

16. A power actuator for a coaxial line switch as claimed in claim 1 which further includes a biasing means for holding said coaxial line switch in spring loaded engagement at either end of its predetermined angle of rotation.

* * * * *